US007992505B2

(12) United States Patent
Ecker

(10) Patent No.: US 7,992,505 B2
(45) Date of Patent: Aug. 9, 2011

(54) METHOD AND APPARATUS FOR OPERATING A THREAD-PRODUCING MACHINE HAVING A THREAD-CUTTING DEVICE

(76) Inventor: Andreas Ecker, Nürtingen (DE)

( * ) Notice: Subject to any disclaimer, the term of this patent is extended or adjusted under 35 U.S.C. 154(b) by 617 days.

(21) Appl. No.: 11/997,149

(22) PCT Filed: Jul. 28, 2006

(86) PCT No.: PCT/EP2006/007510

§ 371 (c)(1),
(2), (4) Date: Aug. 18, 2008

(87) PCT Pub. No.: WO2007/012496

PCT Pub. Date: Feb. 1, 2007

(65) Prior Publication Data

US 2008/0302288 A1 Dec. 11, 2008

(30) Foreign Application Priority Data

Jul. 28, 2005 (DE) ..... 10 2005 035 488

(51) Int. Cl.
*D05B 65/00* (2006.01)
*B26D 1/00* (2006.01)

(52) U.S. Cl. ..... 112/291; 83/697

(58) Field of Classification Search ..... 112/285, 112/298, 300, 302; 83/936, 939, 910, 697, 83/651.1, 15, 16

See application file for complete search history.

(56) References Cited

U.S. PATENT DOCUMENTS

| | | | | | |
|---|---|---|---|---|---|
| 2,619,060 | A | * | 11/1952 | Clark | 112/295 |
| 3,094,031 | A | | 6/1963 | Reeber et al. | |
| 3,163,136 | A | * | 12/1964 | Pickett | 112/130 |
| 3,194,198 | A | * | 7/1965 | Chudner | 112/290 |
| 3,696,770 | A | * | 10/1972 | Dunne et al. | 112/288 |
| 3,905,314 | A | * | 9/1975 | Bolldorf et al. | 112/83 |
| 4,077,340 | A | * | 3/1978 | Braun et al. | 112/131 |
| 4,438,714 | A | * | 3/1984 | Smith et al. | 112/130 |
| 4,735,160 | A | * | 4/1988 | Hampel et al. | 112/288 |
| 5,080,031 | A | | 1/1992 | Suzuki et al. | |
| 5,887,537 | A | | 3/1999 | Panhorst et al. | |

FOREIGN PATENT DOCUMENTS

| | | | |
|---|---|---|---|
| AU | 488494 | | 5/1976 |
| DE | 2802080 | A1 | 7/1979 |
| DE | 2624933 | A1 | 1/1988 |
| DE | 4028216 | C1 | 10/1991 |
| DE | 197 15 558 | C2 | 12/1997 |
| DE | 29819845 | U1 | 3/1999 |
| DE | 10136543 | C1 | 7/2002 |

(Continued)

*Primary Examiner* — Ismael Izaguirre

(74) *Attorney, Agent, or Firm* — Apex Juris, PLLC; Tracy M. Heims

(57) ABSTRACT

The present invention relates to a method and an apparatus for operating a thread-processing machine having a thread-cutting device. In order to provide a method and a corresponding apparatus for operating a thread-processing machine having a thread-cutting device, which achieves improved results with increased operational reliability in comparison with known apparatuses and methods, it is proposed that the processed product (3) is covered with an articulated or flexible protective element to protect the surface of the sewn product in a region around a thread (2) which is to be severed only after the thread-processing operation is ended, and the thread-cutting device (4) is moved onto a cutting point and is positioned for cutting relative to the protective element.

20 Claims, 3 Drawing Sheets

FOREIGN PATENT DOCUMENTS

Figure 1:
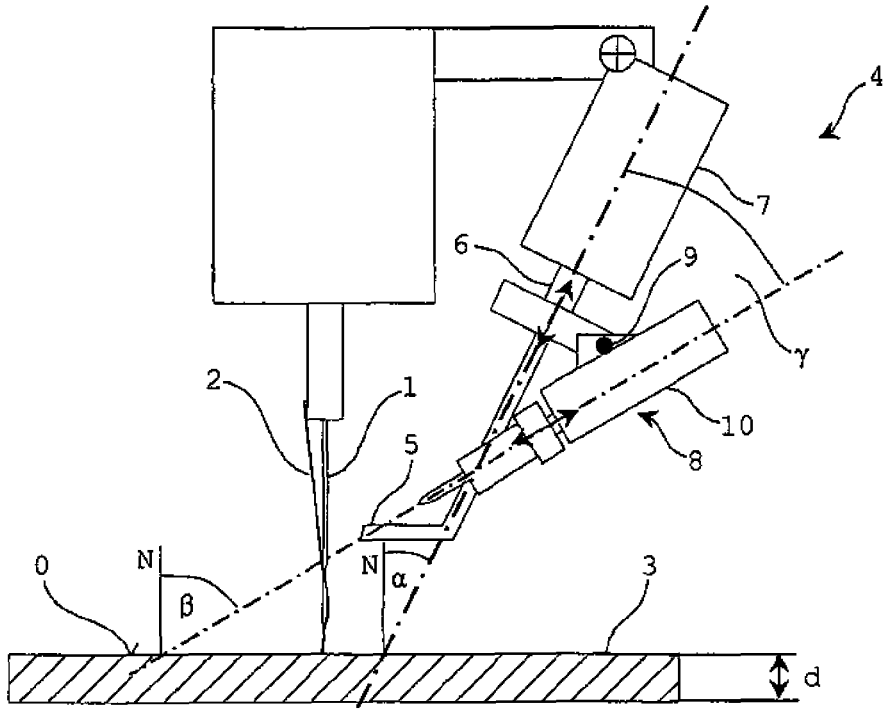

| | | | |
|---|---|---|---|
| JP | 06-016617 | Y | 5/1994 |
| JP | 06126865 | A | 5/1994 |
| JP | 10057652 | A | 3/1998 |
| JP | 2001300171 | A | 10/2001 |

* cited by examiner

METHOD AND APPARATUS FOR OPERATING A THREAD-PRODUCING MACHINE HAVING A THREAD-CUTTING DEVICE

This invention pertains to a method and a device for operating a thread processing machine with a thread cutting unit.

The term thread processing machine within the scope of this invention, apart from sewing machines, also refers to knitting and weaving machines or other machines. From the state-of-the-art technology multiple approaches are known, e.g. proving sewing machines in industrial application with an independently working additional unit for cutting the upper and/or lower threads on completion of the respective sewing sequence. Generally, during a machine rotation that is additionally executed by a positioning motor in a slower manner, at least a thread to be separated is caught with special gripping and holding fingers. After reaching standstill of the machine in an upper thread-giver dead point, the thread is cut through by a knife, a shear, a punch or any similar instrument.

The invention is presented below without any restriction of its application field on the basis of the example of the industrial sewing automatic machines or short sewing stretch automatic sewing machines. Robust and heavy industrial sewing automatic machines find application particularly as short seam sewing automatic machines while sewing up lining pieces, while sewing buckle strap, loops, suitcases, tarpaulins, haver sacks, rucksacks or similar products, that at least partly contain heavy yarn, synthetic materials or leather or even in various forms of load belts or safety belts. Furthermore, even highly safety-relevant elements like gas sacks of air bags that have several seams, are produced with sewing automatic machines. In such sewing machines, since several years regularly sewing yarns made of synthetic material are used that have to be separated frequently even after very short sewing stretches. The products mentioned above as example, regularly have a material top edge on the product or sewing material being processed, which also simultaneously represents an outer visible edge. It is therefore desirable that while using automatic thread cutting units the remaining thread after separating the thread is very short or not visible at all.

According to the state-of-the-art technology, apart from manual fine-processing also special machines for fine-processing of seams are known, which catch the separated threads in a separate working sequence and additionally shorten them. Such a process is very laborious from the point of view of apparatus and time, so that it cannot be carried out in a standardised manner in today's production.

It is therefore the task of this invention to create a method and a corresponding device for operating a thread processing machine with a thread cutting unit that can achieve improved results with enhanced operating reliability, as compared to known devices and methods.

This task is fulfilled by the features of the independent claims. Accordingly, a method for operating a thread processing machine with a thread cutting unit according to the present invention has the special characteristic, that only on completion of the thread processing or sewing sequence the processed product is covered in at least one region around the thread to be separated with an inclined or flexible protective element for protecting the surface of the sewing material and the thread cutting unit is moved to a cutting point and positioned for cutting relative to the protective element. In this way first a protection of the processed product is realised, that can prevent in a very effective manner any kind of damage of the processed product, particularly on its surface, during thread cutting. Besides, by means of positioning of the thread cutting unit relative to the protective element one can realise such a precise positioning of the thread cutting unit that very short thread residues can remain after separation of the thread on the processed product.

Any alteration in the surface of the sewed material has to be ruled out during a thread separating sequence also in the direct vicinity of the residual thread. Otherwise, an optical total impression would be impaired or even safety-relevant mechanical properties of the sewed material would get unfavourably altered. In both cases, the sewed material will become scrap. These requirements are fulfilled according to the present invention by means of the protective element, so that according to the present invention process, sewed material with very short residual thread length and unaltered high surface quality can be reliably processed even in the region of the residual thread.

As positioning of the thread cutting unit takes place relative to the protective element and hence independent of a thickness of the respective processed product, a method according to the present invention and a corresponding device additionally has the advantage of automatic height adaptability. Thus in an embodiment of the invention, a length of a thread residue can be safely adjusted and reproduced with e.g. an enamel bead up to almost 0 mm to approx. 2 mm, independent of thickness of the respective processed product.

In an alternative application field of a method according to the present invention and a corresponding device thread remains that protrude too long are shortened in a defined manner. For this, known devices for arresting such thread remains are used, whereby for example by applying underpressure air suction, the thread residue is drawn into a pipe opening. In a subsequent step, a method according to the present invention is applied, in order to similarly process with high reliability sewed material with very short residual thread length and unaltered high quality also in the region of the residual thread.

As indicated above, a method according to the present invention can be completely de-coupled from an actual sewing sequence. Besides, a method according to the present invention can also be used in working direction, against a working direction or in all other angular positions with respect to a working direction of a thread processing machine. The working steps of a method according to the present invention, i.e. placing of a protection and cutting, can take place in the same or even in different directions.

In an advantageous development of the invention, a protective plate is inserted as protective element in the device. In an embodiment of the invention, the protective element surrounds the perforation point of the thread to be separated or cut on the processed product symmetrically and mainly U-shaped or V-shaped. The protective element is preferably designed one-sided with an edge for forming an abutment for the separating unit during the cutting sequence of the thread. In a further embodiment of invention the protective element is designed in a region of a perforation point non-symmetrically and preferably in L-shape or J-shape.

In an embodiment of the invention, the protective element is pressed under an angle between approx. 25° and up to 50°, preferably however about 30°, by a drive relative to the surface perpendicular of the sewed material on the processed product, in that it is connected to a corresponding positioning and pressing unit. By pressing on, the sewed material is pressed together and/or pressed on to a tap plate in the region around the thread to be separated, so that also a thread separation is possible in a region that in a normal condition lies below the surface of the sewed material. In this way, even residual thread lengths of almost 0 mm can be realised. In a preferred embodiment, this unit consists of a drive that is activated electrically or pneumatically. In embodiments of the invention, the drive is designed as linear cylinder or rotating cylinder or as stepper motors etc.

In alternative embodiments of the invention, an inclined protective element and/or a separating unit is swung in from the side into a working position on the needle of the sewing machine by using a rotating cylinder. In this way, an accessibility of the needle outside a respective separating sequence is increased.

In another embodiment of the invention, the separating device runs at least partly along on the protective element to reach its pre-given position. The protective element is thereby pivoted and/or designed flexible preferably in such a manner that only on coming into contact with the separating device it is pressed on to the processed product. This contact ideally takes place immediately before the actual separating sequence.

In another preferred embodiment of the invention the protective element and the separating unit are coupled with one another and are moved together by only one drive. Such a thread cutting unit is preferably fixed on to the respective sewing machine tilt-able against a spring return force, so that a feed movement of the protective element in contact with the surface of the sewed material can pass over into a cutting movement on tilting the thread cutting unit and removing a pressing force. In another embodiment, the protective element is placed in at least one free end region at an angle against the surface of the sewed material in order to make the tilting easier during the feed movement. The protective element is preferably designed multiple-angled.

In a preferred embodiment of the invention, an electrical burning unit is used as thread cutting unit. Several such units are known that heat up the heating wire with regulated current flow for separating a fitting thread. Ultrasound units, electric arc units, laser units or similar devices can also be used as burning units. As a result of the increased mechanical requirements in modern sewing automatic machines and the needle threads used for sewing, especially in heavy duty sewing machines synthetic threads are used that are made up of several individual yarns. Using knives etc. for banausic separation of a thread can lead in the case of such threads to errors and/or to unsatisfactory cutting results. By using a burning unit and by specifically using electrical energy in a heating wire or similar item, an adequate heat can be generated to separate synthetic threads thermally in such a way that the cut ends get joined to one another even during the separation sequence by a kind of welding or form an fusion bead at the end. Advantageously, by using such a thread cutting unit, the length of the residual thread remaining on the processed product is further reduced by melting an end region of the thread. With the help of the protective element foreseen according to the present invention, the processed product is very effectively protected also against an undesirable thermal influence on its surface, that could occur during the separation sequence by use of the electrical burning unit. It is thus ensured that even the visible surface is not impaired in any way through the thread cutting sequence with respect to its optical and mechanical quality.

When using a heating wire in the separating unit, an approximately U-shaped bent plate is preferably used that has a pronounced tapering in the gorge of the U instead of a wire. In this way a thermal cutting is designed there in a defined manner with the highest temperature.

In a preferred embodiment, a method according to the present invention and a corresponding device for separating the upper threads in tacking sewing automatic machine is used. An adaptation of a device according to the present invention for separating even the lower thread is possible, for example, by using a second mounted device according to the present invention that is arranged below the sewing table adapted to the restricted space available there. In case of backstitch perforation, depending on the requirement, cutting is necessary only above, only below or even above and below the sewing table and can be carried out with the help of the device according to the present invention. By using a method according to the present invention, it is also possible to adapt to a sealing cutting of over-lock threads above the sewing table.

Figure 2:
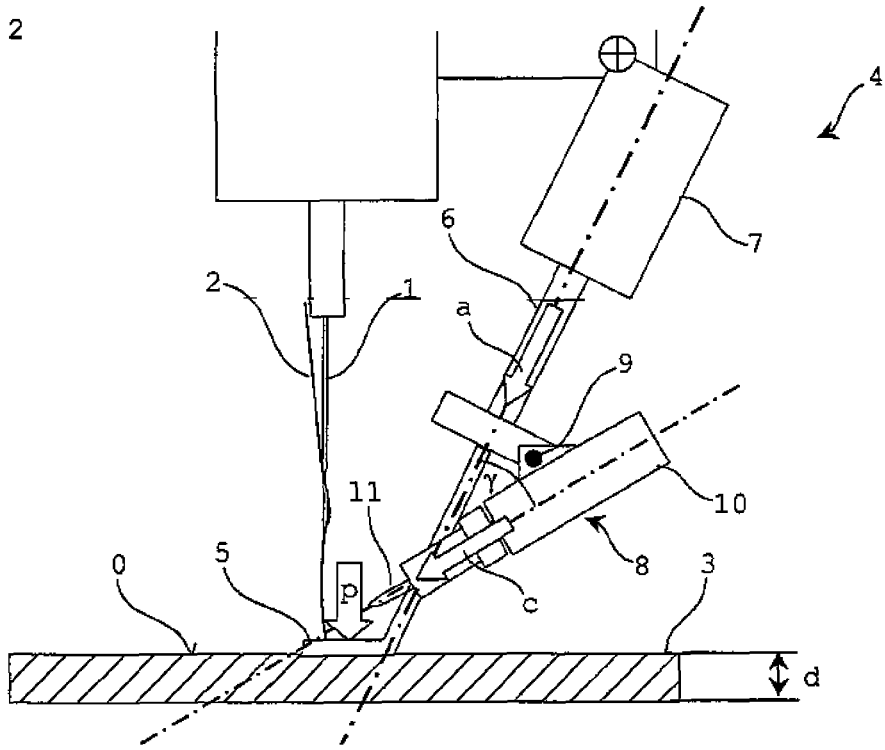
Figure 3:
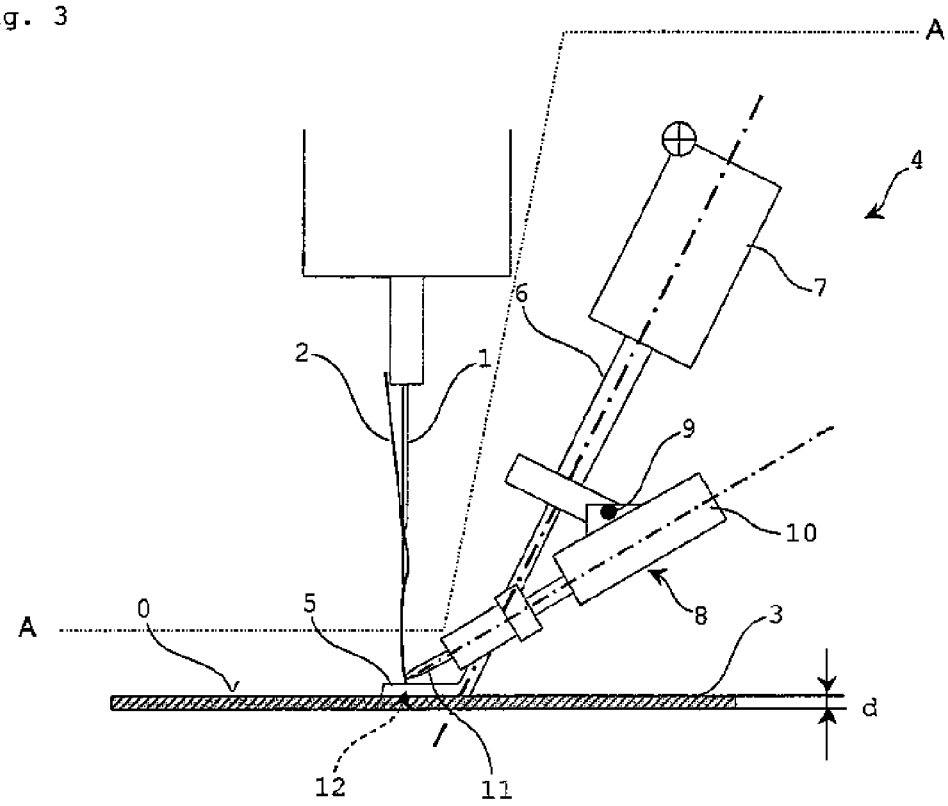
Figure 4:
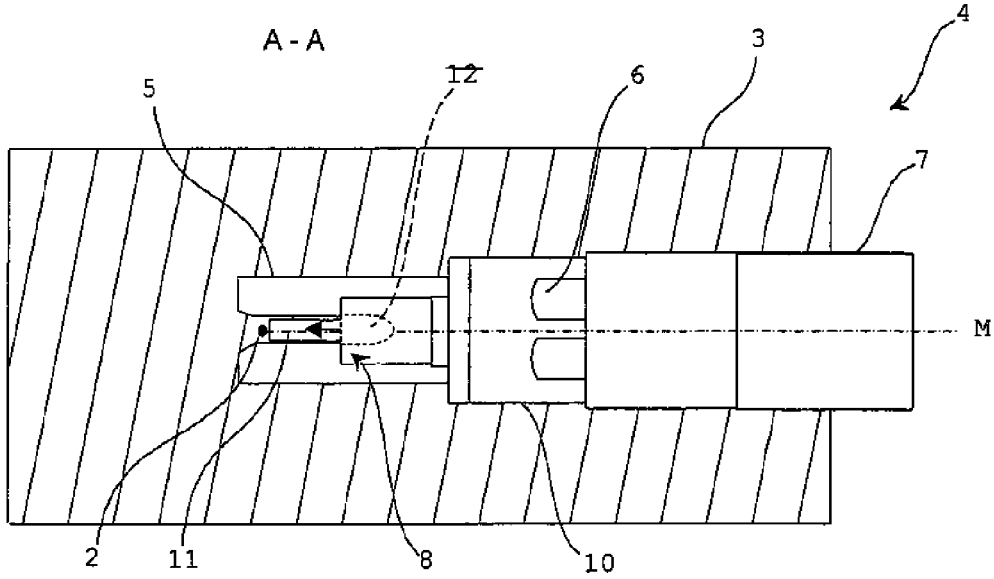
Figure 5:
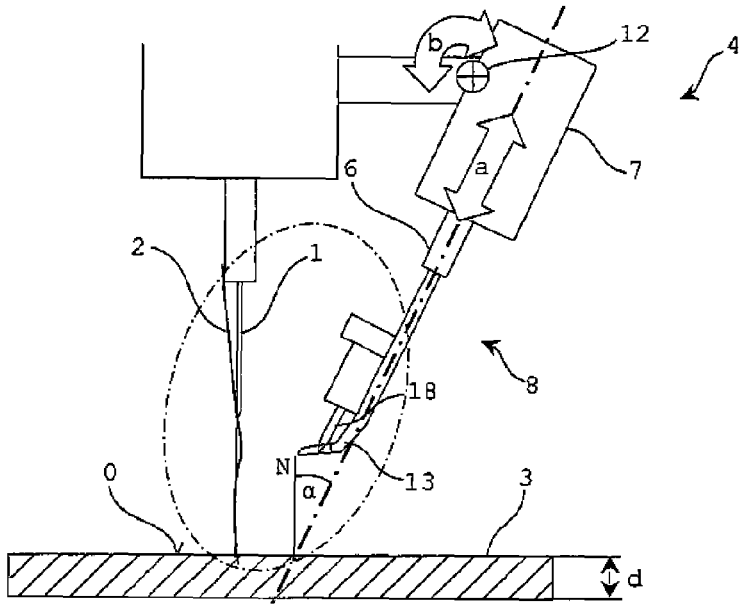
Figure 6A:
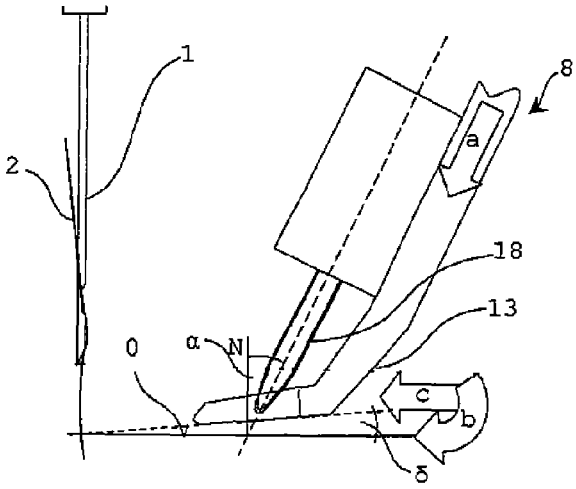
Figure 6B:
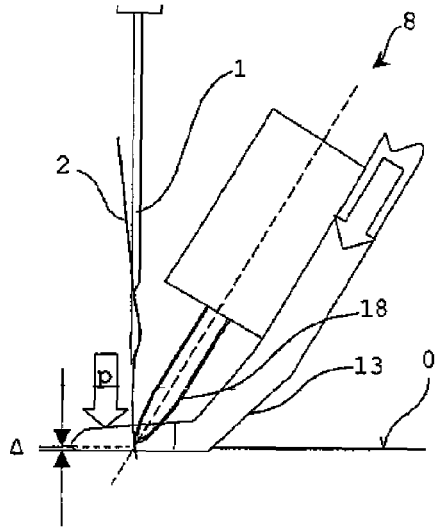
Figure 7:
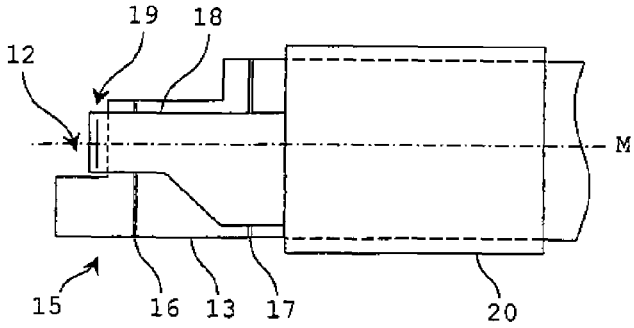

The invention is described in detail below on the basis of a design example and with figures of the drawing for depicting further features and advantages. In the following show:

FIG. 1: a schematic depiction of a running sewing sequence with an embodiment of a thread cutting unit according to invention on a sewing machine in a rest position;

FIG. 2: the design according to FIG. 1 with sunk protective plate during positioning of the separating unit;

FIG. 3: a device according to FIG. 2 during thread separation sequence using a comparatively thinner sewing material as the processed product;

FIG. 4: a top view onto a part of the arrangement according to the figure shown in FIG. 3;

FIG. 5: a further design example of a thread cutting unit analogous to the depiction in FIG. 1;

FIGS. 6*a* and 6*b*: cut-out enlargement of FIG. 5 for depicting the sequences shortly before placing the protective element and while cutting through the thread; and FIG. 7: a top view on a unit made of heat cutting element and protective plate of the second design example.

In all the different diagrams, the same reference signs are always used for the same elements. Without any restriction to the invention, only a treatment of an upper thread at a thread processing machine is depicted and described below in the form of a sewing machine.

FIG. 1 shows a schematic depiction of a running sewing sequence. Only a section of a needle rod of the sewing machine with a needle 1, a thread 2, a sewing table with a processed product 3, here a sewing material 3, as well as an embodiment of a thread cutting unit 4 according to the present invention is shown. The thread cutting unit 4 is built in a very compact manner and can therefore be arranged in principle in any angular direction around the needle 1; here it is aligned fixed. Due to this reason and for increasing the clarity of the drawing, no further orientation marks of the sewing machine have been drawn. In practice, from a respective application and use on the respective machine there occur restrictions of flexibility of positioning.

In this design example, the thread cutting unit 4 is fixed onto the sewing machine, which is not shown in details. The thread cutting unit 4 in the snapshot of FIG. 1 is situated in a rest position, as a sewing sequence is still running and the needle 1 has accordingly not yet come to rest in an upper dead point position.

The thread cutting unit 4 consists of a safety element in the form of a protective plate 5 that is connected by a rod 6 with a linear cylinder 7, through which the protective plate 5 can be moved. In the region of the rod 6, a separating unit 8 is fixed in an adjustable manner around a fulcrum 9 in its angular position, depending on its application. Even the separating unit 8 can be moved through a linear cylinder 10 by using an electronic programming control that has not been depicted in details.

In the diagram in FIG. 2, the needle 1 has reached an upper dead point on completion of the sewing sequence. The thread cutting unit 4 hence comes into action with a first step: the protective plate with the separating unit 5 has been sunk onto a surface 0 of the sewing material 3. In this way, a significant condition for precise positioning of the separating unit 8 is fulfilled, so that the position of the thread 2 to be cut gets automatically positioned according to its respective thickness d of the sewing material 3. Hence a manual fine-alignment of the thread cutting unit 4 is not required. By placing and pressing the protective plate 5 on the surface 0 of the sewing material 3 the separating unit 8 itself is already precisely positioned, as the separating unit 8 is moved relatively towards protective plate 5 only.

FIG. 3 shows a device according to the diagram in FIG. 2 during the thread separating sequence by using a comparatively thinner sewing material. The second linear cylinder 10 has driven the electrical cutting unit of the separating unit 8 to the cutting position; a heating wire 11 is heated up with regulated current flow and cuts off or welds the sewing thread 2 at the exact position. This position is always reliably reached on account of the position of the protective plate 5 according to a pre-setting of the thread cutting unit 4, independent of the material thickness d.

Finally, FIG. 4 shows a top view of a part of the arrangement according to the diagram shown in FIG. 3 in the cutting plane A-A. In this top view the U-shaped design of the protective plate 5 can be clearly identified by a recess 12. The recess 12 in the protective plate 5 that is the main cause for U-shape, now offers the advantageous possibility of cutting the thread 2 above the protective plate 5, in the plane of the surface of the protective plate 5 or below the plane of the surface of the protective plate 5. In an embodiment of the invention, cutting in the recess 12 of the protective plate 5, is possible significantly deeper and hence closer to the surface of the sewing material, than it is possible in the state-of-the-art technology. A suitable pre-setting has to be selected, depending on the case of application, respectively.

The protective plate 5 lies closer around the thread 2 to be separated in comparison to the case of a sewing base that has not been shown in details in the drawing. In industrially used heavy duty sewing machines, a sewing base covers sewing fields of up to approx. 600 mm*3000 mm of rectangular extension, in which the needle 1 executes sewing tasks under pre-given sewing patterns under the effect of an x-y-positioning device. In the special case where the sewing base mainly corresponds to the shape of the protective plate 5, the actual sewing base can be omitted in favour of the protective plate 5. For activating the protective plate also the already available automatic mechanism of the sewing base, a pressing pedal, frame or anything similar can be used. In such cases, also the linear cylinder 7 or a similar drive element for a separate drive of the protective plate 5 can be dispensed with.

In the diagram in FIG. 4, it is also clear that in this embodiment of the invention the movement axes of the linear cylinders 7, 10 independent of one another, lie in one plane but are at different angles against the surface normal of the sewing material 3, and thereby form an angle $\gamma>10°$. The above mentioned angles $\alpha$, $\beta$, $\gamma$ can be freely adjusted in wide ranges and can therefore be set according to the space requirements, i.e. even as equally large angles $\alpha$, i.e. $\gamma=0°$.

In another design example of the invention not depicted as drawing here, the protective plate 5 and the separating unit 8 are arranged in a telescopic mechanism under largely the same angular position to the surface normal of the sewing material 3. Thus in a feed movement 'a' and a cutting movement 'c' take place mainly under the same spatial direction. These elements are thereby driven together in the above described successive working steps by one stepper motor only. For adapting to an application, the angular position of both elements and the allied process steps can however also be designed differently.

FIG. 5 shows another embodiment of the thread cutting unit 4 analogous to the depiction in FIG. 1. Here a protective element 13 and a separating unit 8 are rigidly coupled to one another. They are jointly moved by only one drive in the form of a linear cylinder 7, as already indicated above.

With respect to the sewing material 3 the protective element 13 of the separating unit 8 is arranged as advance running. The thread cutting unit 4 is fixed and pre-set on a fulcrum 14 movable and tilt-able against a spring return force to the sewing machine, which is only indicated in the drawing 5. A feed motion 'a' of the protective element 13 up to a surface contact of the sewing material 3 mainly takes place in a linear manner and then moves over to a cutting motion 'c' under a tilt 'b' of the entire thread cutting unit 4 and subsequent application of the pressing force 'p'. In this way, even in this embodiment, feed motion 'a' and cutting motion 'c' do not take place under the same spatial direction in spite of rigid coupling of the protective element 13 and separating unit 8. The feed motion 'a' runs under the angle $\alpha$ against the surface perpendicular, whereas the cutting motion 'c' mainly runs parallel to the surface 0 of the sewing material 3.

The pressing force 'p' can be adjusted by means of a resilience characteristic of a spring element in the region of the fulcrum 14, that has not been shown in details; however, in this example, it is set by the pre-set maximum shift path of the cylinder 7 and pre-set end stop for limiting the tilting movement 'b'. The direction of the feed motion 'a' is also defined by a pre-set end stop.

The diagrams in FIGS. 6*a* and 6*b* as cut out enlargements of FIG. 5 show the sequences shortly before putting on the protective element 13, i.e. the feed motion 'a' with subsequent tilting 'b' and the proper actual cutting movement 'c'. FIG. 6*b* shows in enlargement the situation during cutting of the thread 2. Here the separating unit 8 has been placed around and pressed on a last perforation point of the thread 2 to be separated. By using a pressing force 'p' the sewing material 3 has been pressed together by a magnitude A. Hence, subsequently in the region of the level of the surface 0, cutting can be done also thermally, without the surface of the sewing material 3 getting damaged; there is still an adequate distance between the surface of the sewing material 3 and an actual cutting element, whereby surrounding regions are safely covered by the protective element.

The protective element 13 is set in a free-end region 15 under an angle $\delta$ against the surface of the sewing material 3. At the end of the feed motion 'a', a contact of the free end region of the protective element 13 with the surface 0 of the sewing material 3 is achieved. The definition of the free end region 15 under the angle $\delta$ serves to facilitate the tilt movement 'd'. In this example the protective element 13 is designed as plate piece that is multiply angled, in order to reach in these stages or bending points 16, 17 altogether an angle of approximately 130° and to allow sliding of the device towards the thread cutting.

FIG. 7 shows a further speciality of the composition of the protective element 13 and an adjustment of a heating-cutting element 18 in this case of application. A top view on a unit of the heating-cutting element 18 and the protective plate of the protective element 13 of this second design example shows, that the protective element 13 has an L-shaped, and hence non-symmetric to the centre axis M, recess 12 on its free end 15. On chamfering the inner edge, the recess 12 can also run in J-shape. An almost U-shaped bent tapering 19 of the heating-cutting element 18 reaches into the recess 12; in the course of each cutting movement 'c' to a thread 2 to be separated in the region of a perforation point is guided through the free end of the protective element 13 to the U-shaped bent tapering 19 of the heating-cutting element 18. The heating-cutting element 18 is held in an electrically insulated block 20 that has terminals for current feeders, which has not been shown in details.

To sum up, a method and a corresponding device have been described, that offer an effective surface protection for the yarn, or a seam and/or a processed product during a thread separation sequence, and that cuts a residual thread short in a defined manner without any surface damage or other mechanical impairment of the sewing material. Besides, this advantageous property is ensured without mechanical adaptation, by means of an automatic, flexible height adjustment. The height adjustment can be controlled by additional monitoring mechanism and also electronically checked and/or protocolled. Such measures are however not necessary in principle.

A device according to the present invention of the type described above can also be used in an advantageous manner in conjunction with multiple needle sewing machines. For highly safety-relevant sewing products, e.g. gas sacks of air bags, double seams are done with two parallel needles at a distance of at least 6 to 8 mm. Up to 70 of such double seams can be found on an air bag-gas bag, which have to have defined short residual threads at the beginning and end. In case of a narrow needle distance such a double needle sewing machine can be provided with a device according to the present invention, whereby a respective protective element and one or two heat cutters have to be adapted to the geometry. Also it is possible to use two devices according to the present invention running parallel, as they take up working space below the sewing machine only for thread cutting and can be structured in a very slim manner.

A starting thread can also similarly be processed by adapted application of a device according to invention, while a thread arrester, e.g. with a suction mechanism, arrests a respective starting thread, clamps it in mechanically and positions it in such a way that it can be cut preferably by a separately provided device according to the present invention. This sequence can run, with correspondingly controlling the process, on a sewing table even outside the actual region of the sewing machine.

LIST OF REFERENCE SIGNS

1. Needle
2. Thread
3. Processed product/sewing material
4. Thread cutting unit
5. Protective plate
6. Rod
7. Linear cylinder
8. Separating unit
9. Fulcrum
10. Linear cylinder
11. Heating wire
12. Recess of the protective plate 5/protective element 13
13. Protective element
14. Fulcrum
15. Free end region of the protective element 13
16. Bending point
17. Bending point
18. Heating-cutting element
19. Tapering
20. Electrical insulation block
a. Feed motion
b. Tilting
c. Cutting motion
d. Thickness of the processed product or sewing material 3
p. Pressing force
$\alpha$. Angle of feed axis
$\beta$. Angle of cutting axis
$\gamma$. Angle between the directions a and c
$\delta$. Angle of the free end region 15
$\Delta$. Penetration depth of protective element 13 into the sewing material 3
M. Centre axis
N. Surface normal
O. Surface of the sewing material 2.

I claim:

1. A method for operating a thread processing machine with a thread cutting unit, wherein the processed product is covered only on completion of the thread processing sequence with an inclined or flexible protective element for protecting the surface of the sewing material in a region around a thread to be separated, where the protective element is sunk and pressed under an angle ($\alpha$) with $25° \leqq \alpha \leqq 50°$ relative to the surface normal onto the processed product and subsequently the thread cutting unit is moved towards the cutting point under an angle ($\beta$) and is positioned relative to the protective element for cutting.

2. The method according to claim 1, wherein the protective element is sunk and pressed under the angle ($\alpha$) $\alpha \cong 30°$ relative to the surface normal (N) by means of a drive on to the processed product.

3. The method according to claim 1, wherein a separating unit (8) is driven by a drive under the angle ($\beta$) into a cutting position and the thread is separated.

4. The method according to claim 1 the protective element inclined under the angle ($\alpha$) and/or a separating unit at an inclination of an angle ($\beta$) by a drive, are swung in from the side by using a rotating cylinder.

5. The method according to claim 1, wherein the separating unit, in order to reach the pre-given position, runs at least partly along the protective element and/or slides with the protective element over the material.

6. The method according to claim 1, wherein the thread is thermally separated.

7. The method according to claim 1, wherein the protective element and the separating unit are mechanically rigidly coupled with one another and are moved by a common drive.

8. The method according to claim 1, wherein the protective element and the separating unit are guided in different directions of motion (a, c) that are at an angle ($\gamma$) to one another.

9. The method according to claim 1, wherein a feed motion (a) runs off into a cutting motion (c) after a tilt (b) of an angle ($\delta$) of $\delta \cong 5°$.

10. A device for operating a thread cutting machine with a thread cutting unit, wherein a thread cutting unit is provided that has a protective element that is designed in such a way that it can be sunk as surface protection on to the processed product under an angle ($\alpha$) with $25° \leqq \alpha \leqq 50°$ relative to the surface normal (N); the protective element covers the processed product in an inclined or flexible manner in a region around the thread to be separated, and the separating unit is provided for gripping into the protective element.

11. The device according to claim 10, wherein
the protective element in mechanically and rigidly coupled with the separating unit for positioning of the separating unit.

12. The device according to claim 10, wherein
the protective element and the separating unit are designed in a swivel-able and/or drivable manner and aligned oriented in the working direction of the machine.

13. The device according to claim 10, wherein
the protective element is designed as a protective plate, adapted pressure pedal, sewing base, frame.

14. The device according to claim 10, wherein
the protective element is designed surrounding the perforation point of the thread to be separated or cut on the surface product, largely in symmetrical U-shape or V-shape.

15. The device according to claim 10, wherein
a recess of the protective element is designed and positioned in such a way that an edge for forming a one-sided abutment is formed, particularly for guiding the thread.

16. The device according to claim 10, wherein
the protective element is designed to enclose the perforation point of the thread to be separated or cut on the processed product, mainly in non-symmetric L-shape or J-shape.

17. The device according to claim 10, wherein
the protective element is connected to a positioning and pressing unit for pressing under an angle ($\alpha$) of $\alpha \approx 30°$ against a surface normal (N) onto the processed product (3); this unit includes a linear or rotating cylinder or a stepper motor.

18. The device according to claim 10, wherein
in the thread cutting unit an electrical separating unit is provided that particularly has a heating wire, an ultrasonic unit, a laser unit or an arc unit.

19. The device according to claim 10, wherein
a protective element and a separating unit that are rigidly coupled to one another are jointly moved by only one drive in the form of a linear cylinder, whereby with respect to the processed material the protective element is arranged in an advancing manner with respect to the separating unit.

20. The device according to claim 10, wherein
the thread cutting unit is fixed in a pre-settable manner that is movable and is tilt-able against a spring return force at a fulcrum point on a working machine.

* * * * *